US011846288B2

(12) United States Patent
Wei et al.

(10) Patent No.: US 11,846,288 B2
(45) Date of Patent: Dec. 19, 2023

(54) SCROLL COMPRESSOR INCLUDING SILENCER DEVICE CONTAINING SILENCING HOLES

(71) Applicant: EMERSON CLIMATE TECHNOLOGIES (SUZHOU) CO., LTD., Suzhou (CN)

(72) Inventors: Yuanyuan Wei, Suzhou (CN); Tao Yang, Suzhou (CN); Chao Jiang, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 0 days.

(21) Appl. No.: 17/254,835

(22) PCT Filed: Jun. 21, 2019

(86) PCT No.: PCT/CN2019/092245
§ 371 (c)(1),
(2) Date: Dec. 21, 2020

(87) PCT Pub. No.: WO2019/242721
PCT Pub. Date: Dec. 26, 2019

(65) Prior Publication Data

US 2021/0262470 A1 Aug. 26, 2021

(30) Foreign Application Priority Data

Jun. 22, 2018 (CN) ..... 201820985551.1

(51) Int. Cl.
*F04C 29/06* (2006.01)
*F04C 18/02* (2006.01)
(Continued)

(52) U.S. Cl.
CPC ..... *F04C 29/06* (2013.01); *F04C 18/0215* (2013.01); *F04C 27/00* (2013.01);
(Continued)

(58) Field of Classification Search
CPC ..... F04C 29/06; F04C 18/0215; F04C 27/00; F04C 28/24; F04C 29/068; F04C 29/126; F04C 2240/80
See application file for complete search history.

(56) References Cited

U.S. PATENT DOCUMENTS 4,767,293 A * 8/1988 Caillat ..... F04C 18/0253 418/57
4,877,382 A * 10/1989 Caillat ..... F01C 19/08 418/57
(Continued)

FOREIGN PATENT DOCUMENTS

CN 1280251 A 1/2001
CN 101270751 A 9/2008
(Continued)

OTHER PUBLICATIONS

International Search Report (English and Chinese) and Written Opinion (Chinese) of the International Searching Authority issued in PCT/CN2019/092245, dated Aug. 23, 2019; ISA/CN.
(Continued)

*Primary Examiner* — Dominick L Plakkoottam
*Assistant Examiner* — Paul W Thiede
(74) *Attorney, Agent, or Firm* — Harness, Dickey & Pierce, P.L.C.

(57) ABSTRACT

A scroll compressor including a scroll assembly comprising an orbiting scroll and a non-orbiting scroll; and a silencing device provided above the scroll assembly and comprising a partition plate and a silencer. The partition plate is used to divide an interior space of the scroll compressor into a high-pressure chamber and a low-pressure chamber, and the partition plate has a central through-hole. The silencer is arranged above the gas outlet, the silencer is fixed to the central through-hole, and is independent from the scroll assembly. The silencing device of the scroll compressor can
(Continued)

eliminate noise and seal the divided high-pressure and low-pressure chambers, and can be arranged flexibly without interfering with the scroll assembly.

14 Claims, 16 Drawing Sheets

(51) Int. Cl.
*F04C 27/00* (2006.01)
*F04C 28/24* (2006.01)
*F04C 29/12* (2006.01)

(52) U.S. Cl.
CPC ..... *F04C 28/24* (2013.01); *F04C 29/068* (2013.01); *F04C 29/126* (2013.01); *F04C 2240/80* (2013.01)

(56) References Cited

U.S. PATENT DOCUMENTS 5,591,014 A * 1/1997 Wallis ..... F04C 28/26 417/310
5,649,816 A * 7/1997 Wallis ..... F04C 18/0253 417/313
5,800,141 A * 9/1998 Ceylan ..... F04C 28/28 418/270
5,921,761 A * 7/1999 Eckels ..... F04C 29/068 418/55.1
6,220,839 B1 * 4/2001 Sheridan ..... F04C 23/008 418/181
6,352,417 B1 3/2002 Zamudio et al.
6,390,792 B1 5/2002 Tarng et al.
7,207,787 B2 * 4/2007 Liang ..... F04C 18/0215 417/310
2001/0002980 A1 6/2001 Sheridan et al.
2006/0233657 A1 * 10/2006 Bonear ..... F04C 28/28 418/55.6
2012/0148433 A1 * 6/2012 Liang ..... F04C 18/0215 418/55.1

FOREIGN PATENT DOCUMENTS

CN 202228358 U 5/2012
CN 202937456 U 5/2013
CN 208651145 U 3/2019
EP 0822335 A2 * 2/1998
JP 2006242178 A * 9/2006 ..... F04C 18/02
JP 2006300051 A * 11/2006 ..... F04C 28/28
JP 2011047310 A * 3/2011
KR 20000009730 A 2/2000
KR 1020030044252 A * 6/2003
KR 1020040107093 A * 12/2004

OTHER PUBLICATIONS

Extended European Search Report regarding Patent Application No. 19822567.4, dated Feb. 21, 2022.

* cited by examiner

SCROLL COMPRESSOR INCLUDING SILENCER DEVICE CONTAINING SILENCING HOLES

CROSS-REFERENCE TO RELATED APPLICATIONS

The present application is the national phase of International Application No. PCT/CN2019/092245 titled "SCROLL COMPRESSOR" and filed on Jun. 21, 2019, which claims the priority to the Chinese Patent Application NO. 201820985551.1, titled "SCROLL COMPRESSOR", filed on Jun. 22, 2018, with the China National Intellectual Property Administration, the entire content of which is incorporated herein by reference.

TECHNICAL FIELD

The present disclosure relates to scroll apparatus, in particular to a scroll compressor with a silencing device.

BACKGROUND

The content in this section only provides background information related to the present disclosure, which may not constitute prior art.

A compressor is a fluid machine that promotes low-pressure gas to high-pressure gas, and is the core apparatus in a refrigeration system. The scroll compressor is a typical positive displacement compressor. The main part of the scroll compressor is a scroll assembly, which is used to compress a fluid. The scroll assembly generally includes a non-orbiting scroll and an orbiting scroll that are stacked on each other, and a cross slip ring coupled to the non-orbiting scroll and the orbiting scroll respectively to prevent the orbiting scroll from spinning, for example.

The non-orbiting scroll and the orbiting scroll of the scroll assembly cooperates with each other in a stacked manner, where the orbiting scroll is arranged eccentrically opposite to the non-orbiting scroll. A motor in the scroll compressor drives a crankshaft to make the orbiting scroll move along a predetermined trajectory relative to the non-orbiting scroll, so that a series of crescent-shaped compression spaces are formed between the scroll profiles of the orbiting scroll and the non-orbiting scroll.

Significant noise is generated during the working process of the scroll compressor. The noise is mainly the noise of the scroll assembly compressing the gas, the exhaust noise at the gas outlet of the scroll assembly, and the noise of vibration and flapping of the reed valve at the gas outlet of the scroll assembly and the like. At present, many methods have been proposed for isolating or reducing the operating noise of the compressor, such as improving the body structure design of the compressor, equipping the compressor with a sound-proof cover, and arranging a silencer at the source of noise. For the solution of arranging a silencer, a known method is to add a silencer to the scroll assembly, which can be used to eliminate exhaust noise at the gas outlet of the scroll assembly and the like.

A scroll compressor with a silencer is known, in which the silencer used is generally a cup-shaped structure, and multiple silencing holes are formed in the side wall of the cup-shaped structure. The silencer is fixedly arranged on the inner hub of the non-orbiting scroll and located above the gas outlet of the non-orbiting scroll, thereby reducing the exhaust noise at the gas outlet.

The silencer used in the existing compressor is directly arranged to the inner hub of the non-orbiting scroll. Based on this structure, a more suitable way to fix the silencer is threaded connection. Threaded connection requires threads to be formed on the circumferential wall of the inner hub of the non-orbiting scroll, so that the inner hub needs to have sufficient thickness of the wall to meet the requirements of both threaded connection and structural strength. Therefore, it is difficult to apply this type of silencer to a compressor with a thinner thickness of the wall of the inner hub of the non-orbiting scroll.

The present disclosure expects to propose a solution to this problem.

SUMMARY

An object of the present disclosure is to provide a scroll compressor with an improved silencing device, the silencing device is flexible in arrangement, has increased versatility, and is suitable for various types of scroll assembly.

Another object of the present disclosure is to provide a scroll compressor with an improved silencing device, which has a simplified structure, is easy to assemble, and has the dual functions of silencing and isolating the high-pressure and low-pressure chambers of the compressor.

For the above purpose, according to one aspect of the present disclosure, a scroll compressor is provided, including: a scroll assembly comprising an orbiting scroll and a non-orbiting scroll, the orbiting scroll and the non-orbiting scroll each including an orbiting scroll profile and a non-orbiting scroll profile and cooperating with each other to form a series of compression chambers, and the scroll assembly defining a gas outlet; and a silencing device arranged above the scroll assembly and including a partition plate and a silencer, the partition plate being configured to divide an internal space of the scroll compressor into a high-pressure chamber and a low-pressure chamber, the partition plate having a central through hole, the silencer being arranged above the gas outlet, where the silencer is fixed to the central through hole and is independent from the scroll assembly.

Based on this scroll compressor, the silencer is fixed to the partition plate instead of the scroll assembly, and is independent from the scroll assembly, so it will not affect the structure of the scroll assembly and can be applied to various types of scroll assemblies; At the same time, the silencer is not only used to eliminate noise, but also seals and isolates the high-pressure chamber from low-pressure chamber of the compressor by virtue of its annular flange together with the partition plate for example, which has the dual functions of silencing and isolating the high-pressure and low-pressure chambers.

Preferably, the silencer may be fixed to the central through hole by welding, interference fit or threaded connection so as to be fixed to the partition plate; or the partition plate may further have a central flange portion extending upward from the periphery of the central through hole, and the silencer may be fixed to the central through hole and the central flange portion by welding, interference fit or threaded connection so as to be fixed to the partition plate. In this way, the silencer is allowed to be conveniently and firmly fixed to the partition plate.

Preferably, the bottom of the silencer may be formed with an external thread on the outer side, and the inner side of the central through hole of the partition plate may be formed with a corresponding internal thread; or, in the case that the partition plate has the central flange portion, the bottom of the silencer may be formed with an internal thread on the inner side, and the outer side of the central flange portion of the partition plate may be formed with a corresponding external thread. In this way, the silencer is allowed to be further conveniently and firmly fixed to the partition plate.

Preferably, the silencer may include a cylindrical body with one or more silencing holes formed in the top and/or side wall of the cylindrical body.

Preferably, the silencer may further include an annular flange extending radially outward along the bottom of the cylindrical body, and the annular flange may abut against the bottom surface or the top surface of the partition plate in the state where the silencer is positioned in place. In this way, the silencer is allowed to be more accurately positioned with respect to the partition plate by means of the annular flange and fixed to the partition plate more reliably.

Preferably, the annular flange may abut against the bottom surface of the partition plate, such that the annular flange may be configured as a sealing plate adapted to engage with a corresponding sealing member to seal and isolate the high-pressure chamber from the low-pressure chamber. In this way, the use of an additional sealing member such as a sealing plate attached to the partition plate is eliminated, so that the silencer can function as sealing and partition in addition to the sound attenuation.

Preferably, the top of the cylindrical body may include multiple silencing holes arranged in an annular form, and/or, the side wall of the cylindrical body may include multiple silencing holes arranged in the circumferential direction.

Preferably, the height of the cylindrical body may range from 20 mm to 40 mm, and/or the radial dimension of the cylindrical body may range from 20 mm to 80 mm.

Through the special design of the number, size and position of the silencing holes and the size of the cylindrical body, the processing of the silencer is easier and the noise reduction effect is good (especially for a specific frequency).

Preferably, the scroll compressor may further include a reed valve arranged at the gas outlet, and the silencer may be arranged to align with the gas outlet to reduce the operating noise of the reed valve. In this way, the silencer can effectively and accurately reduce the noise especially for the operating noise of the reed valve.

Preferably, the scroll assembly may include a recess provided on the side of the non-orbiting scroll facing away from the orbiting scroll, and the scroll compressor may further include a floating seal ring assembly arranged in the recess to define a back pressure chamber.

Preferably, the floating seal ring assembly may have a sealing top end abutting against the annular flange of the silencer to seal and isolate the high-pressure chamber from the low-pressure chamber.

By engaging the annular flange of the silencer with the sealing top end of the floating seal ring assembly, the annular flange of the silencer is advantageously used to simply realize sealing and isolation of the low-pressure chamber from the high-pressure chamber in a case that the floating seal ring assembly for defining the back pressure chamber is provided.

Preferably, the floating seal ring assembly may have a lip extending radially inward from the sealing top end, and the scroll compressor may further include a check valve sheet arranged on the lip to cover the air flow channel at the inner side of the lip.

Preferably, the scroll compressor may further include a stop member accommodated inside the silencer for limiting the upward movement range of the check valve sheet.

By arranging a check valve sheet on the floating seal ring assembly and providing a stop member inside the silencer, the check valve sheet can be used to easily prevent high pressure gas from flowing back in the case that the reed valve is not provided but only the check valve sheet is provided. At the same, the silencer does not interfere with the check valve sheet and the stop member.

DETAILED DESCRIPTION OF THE EMBODIMENTS

Figure 1:
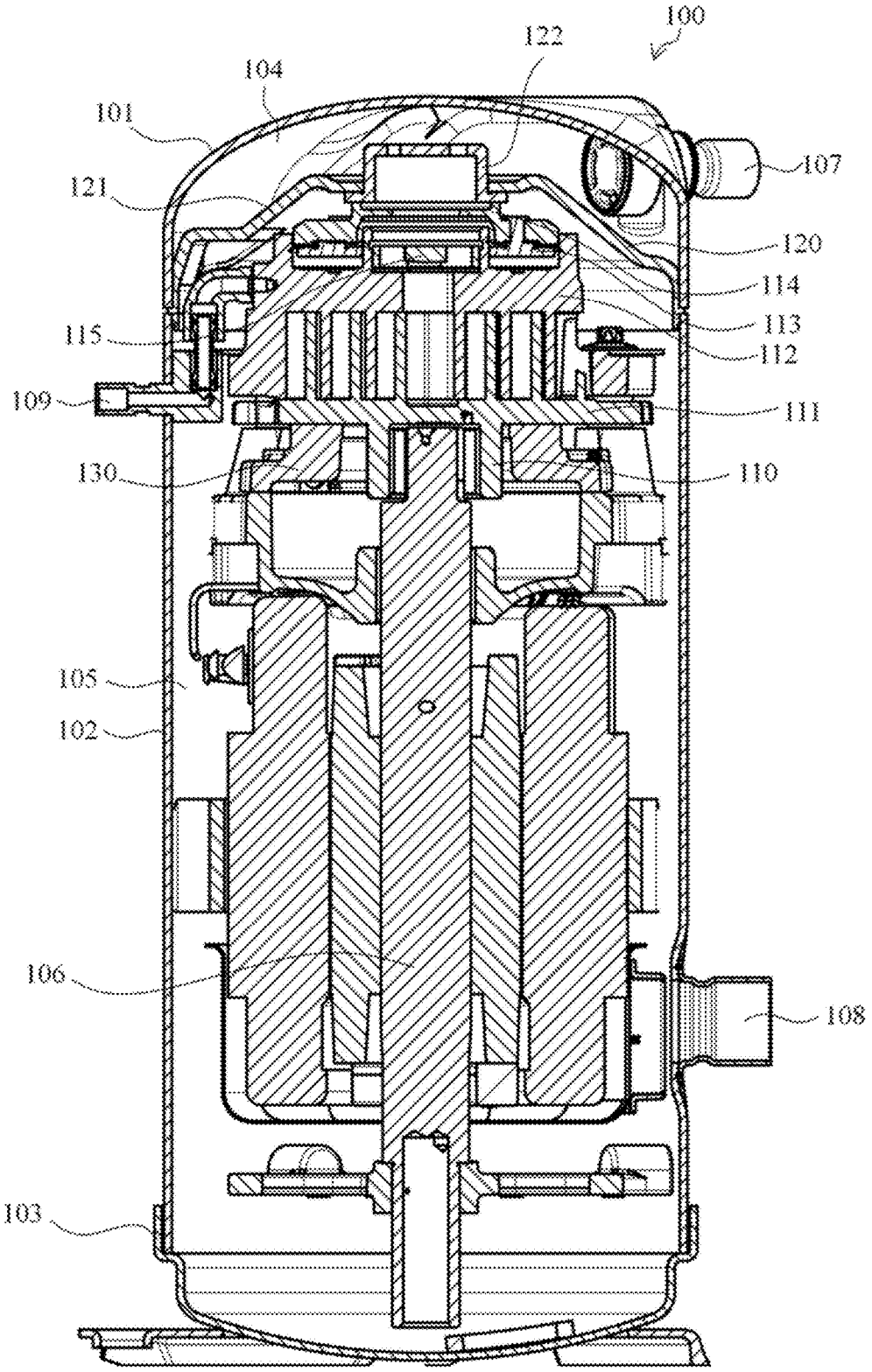
FIG. 1 is a longitudinal sectional view of a scroll compressor according to an embodiment of the present disclosure.

The following description of the preferred embodiments is only exemplary, and is by no means a limitation to the present disclosure and its application or usage. The same reference numerals are used in the various drawings to denote the same components, and therefore, the configuration of the same components will not be described repeatedly.

The azimuth terms such as "above", "upward", "top" and "bottom" used herein are described for the normal operating arrangement of the vertical scroll compressor. That is, the use of these azimuth terms is only for the purpose of facilitating description, and should not be regarded as restrictive. For example, in the case of a horizontal compressor, "above" may correspond to "left" or "right".

The structure and operating mode of the scroll compressor and its improved components according to the present disclosure will be described with reference to the accompanying drawings below.

FIG. 1 first shows one example of a scroll compressor 100 according to the present disclosure. The scroll compressor 100 adopts an improved silencing device 120 and a scroll assembly 110 thus improved.

A compressor 100 mainly includes a compressor housing composed of a top cover 101, a housing body 102 and a base 103. The space in the compressor housing is divided into a high-pressure chamber 104 and a low-pressure chamber 105. A scroll assembly 110 is located in the low pressure chamber 105, is arranged on a thrust bearing 130, and is driven by a main shaft 106 to compress a gas.

The scroll assembly 110 mainly includes an orbiting scroll 111 and a non-orbiting scroll 112 arranged above the orbiting scroll 111 in an opposed manner. The gas entering the low-pressure chamber 105 through an intake port 108 is sucked into the compression chambers between the orbiting scroll 111 and the non-orbiting scroll 112 via the intake port on the outer peripheral wall of the non-orbiting scroll 112 so as to be compressed, and then discharged through a gas outlet 110*a*. The gas compression chambers are formed by a scroll profile 111*a* of the orbiting scroll 111 and a scroll profile 112*a* of the non-orbiting scroll 112 together.

Figure 2:
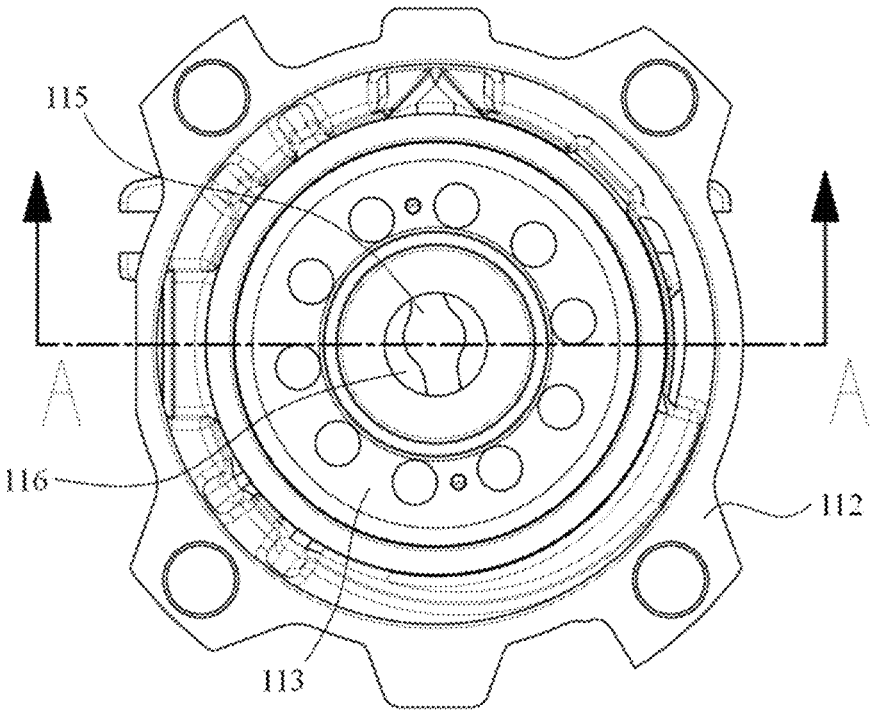
FIGS. 2 and 3 respectively show a top view and a cross-sectional view of a scroll assembly according to an embodiment of the present disclosure.
Figure 3:
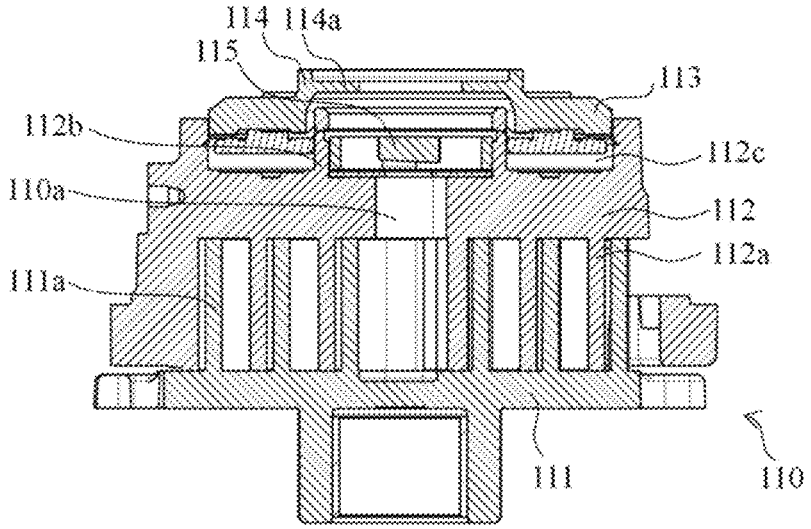
Figure 4:
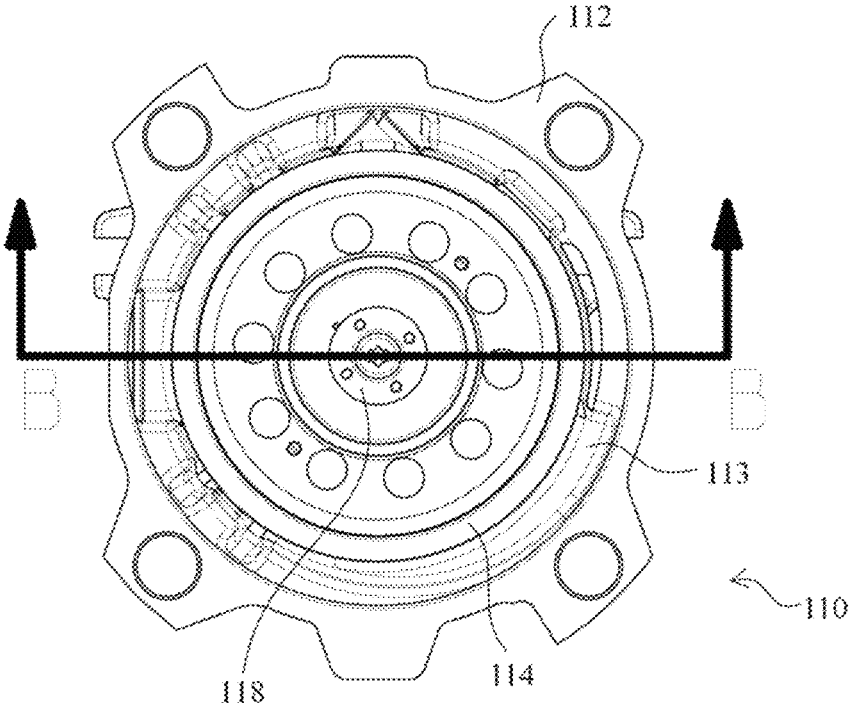
FIGS. 4 and 5 respectively show a top view and a cross-sectional view of another scroll assembly according to an embodiment of the present disclosure.
Figure 5:
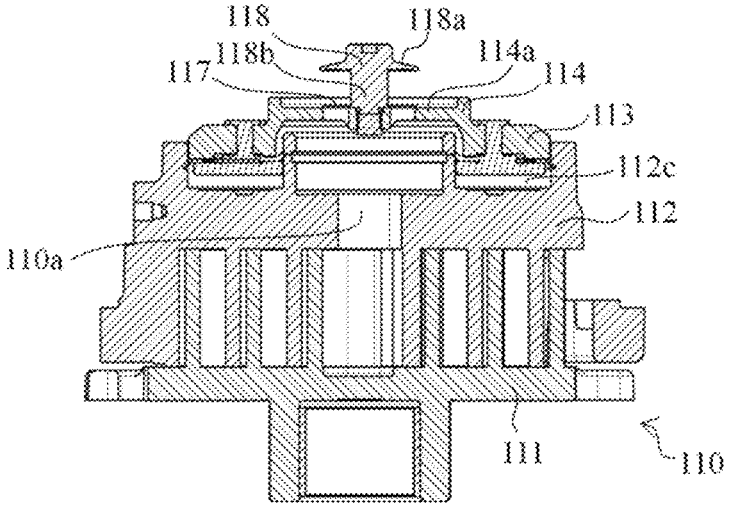

FIGS. 2 to 5 show schematic diagrams of two exemplary scroll assemblies 110. The scroll assembly 110 shown in FIGS. 2 and 3 is provided with a reed valve (HVE valve) 115 and a floating seal ring assembly 113 without a check valve sheet 117. The scroll assembly 110 shown in FIGS. 4 and 5 is provided with a floating seal ring assembly 113 with a check valve sheet 117 and an additional check valve sheet stop stud 118. Due to the use of the newly designed silencing device 120, the scroll assembly 110 according to the present disclosure can use the floating seal ring assembly 113 with the check valve sheet 117, so that the optional type of floating seal ring assembly will not be affected by the silencing device 120.

The scroll assembly 110 in FIGS. 2 and 3 is the same as the scroll assembly used in the compressor 100 of FIG. 1. The gas outlet 110*a* is disposed in the center of the end plate of the orbiting scroll 112, an inner hub 112*b* of the orbiting scroll 112 is formed to extend upward from the end plate around the gas outlet 110*a*, and a reed valve 115 is arranged inside the inner hub 112*b* and is located directly above the gas outlet 110*a*. The floating seal ring assembly 113 is arranged in a recess on one side of the orbiting scroll 112 facing away from a non-orbiting scroll 111, and is installed in a manner of being set outside the inner hub 112*b* of the orbiting scroll 112, thereby defining a back pressure chamber 112*c*. The compressed gas discharged via the gas outlet 110*a* pushes up the reed valve 115 and flows through the upper central opening of the floating seal ring assembly 113 above the orbiting scroll 112 so as to be discharged, as shown in FIG. 3.

Here, the reed valve 115 is mainly used to stabilize the pressure of the gas discharged from the gas outlet 110*a* to ensure that the discharged gas has a required sufficient pressure. The floating seal ring assembly 113 is mainly used to form a back pressure chamber 112*c* above the orbiting scroll 112 to always press the orbiting scroll 112 toward the non-orbiting scroll 111.

FIGS. 4 and 5 show the scroll assembly 110 in another embodiment. The difference from the embodiment of FIGS. 2 and 3 is that the scroll assembly 110 is not provided with a reed valve 115, but a check valve sheet 117 is provided at a lip 114*a* extending radially inward of the sealing top end 114 of the floating seal ring assembly 113, and the check valve sheet 117 opens or closes in response to the pressure difference between the inner and outer sides thereof. The compressed gas discharged from the gas outlet 110*a* enters the floating seal ring assembly 113 and then pushes the check valve sheet 117 at the top so as to be discharged, as shown in FIG. 5. At the same time, a check valve sheet limiting stud 118 which penetrates the check valve sheet 117 of the floating seal ring assembly 113 is also provided. The check valve sheet limiting stud 118 has a rod portion 118*b* serving as a guide section and a stop portion 118*a* extending outwardly formed on the upper part. When the check valve sheet 117 is pushed up by the pressure below, the check valve sheet 117 can move along the guide rod portion 118*b*, and the stop portion 118*a* prevents the check valve sheet 117 from escaping due to excessive exhaust pressure of the high-pressure gas.

The scroll assembly 110 in FIG. 5 can be used together with the silencing device 120 according to the present disclosure without interfering with each other. In contrast, due to the silencer in the existing silencing device being directly installed on the inner hub of the orbiting scroll, the floating seal ring assembly with check valve sheet cannot be used because the silencer will hinder the arrangement of the check valve sheet on the floating seal ring assembly.

The gas discharged from the scroll assembly 110 enters the silencing device 120 above (in particular, enters the silencer 122 of the silencing device 120) for noise reduction. The noise-reduced gas enters the high-pressure chamber 104 after leaving the silencing device 120, and then is discharged from the compressor 100 via the exhaust port 107.

Figure 6:
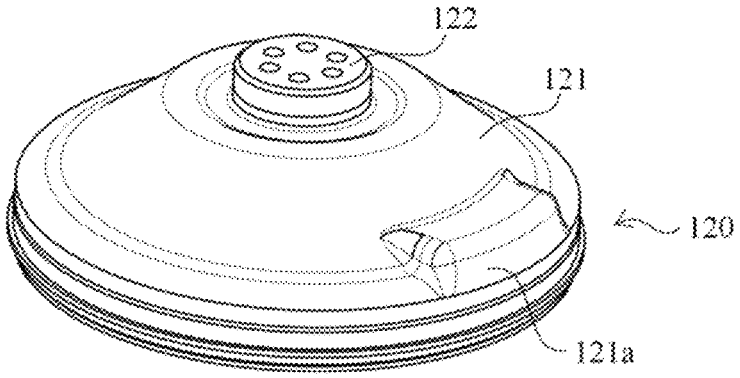
FIGS. 6 and 7 respectively show an assembled state diagram and an exploded state diagram of the silencing device according to an embodiment of the present disclosure.
Figure 7:
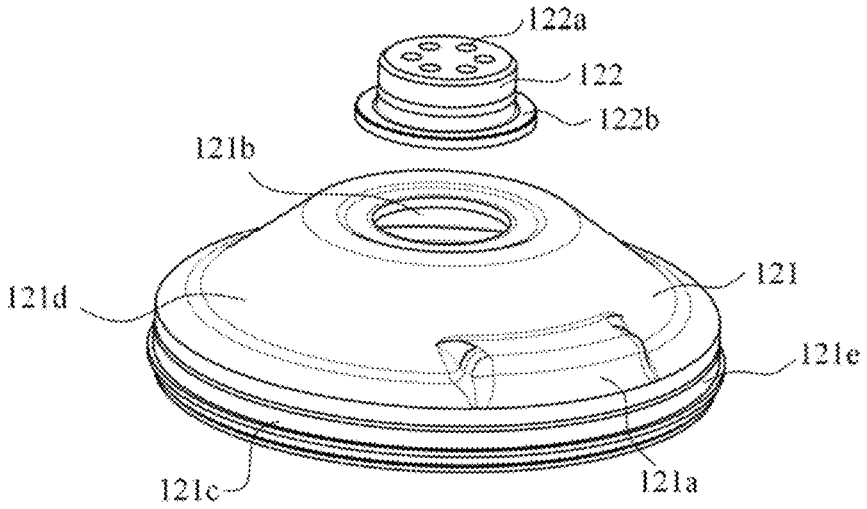
Figure 8:
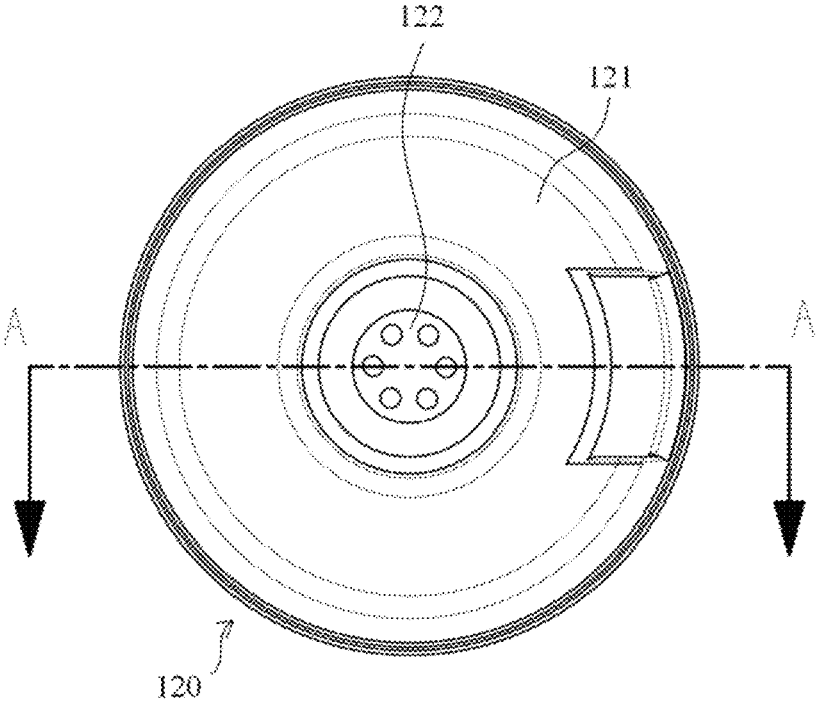
FIG. 8 shows a bottom view of the silencing device in FIG. 6.

FIGS. 6 and 7 show a silencing device 120 according to one embodiment of the present disclosure. The silencing device 120 according to the present embodiment includes a partition plate 121 and the silencer 122. After the compressed gas enters the silencer 122, the noise is attenuated to achieve a noise reduction effect. The partition plate 121 has an umbrella configuration similar to a "lid", and extends toward the outside to cover the entire scroll assembly 110 (as shown in FIG. 1). The silencer 122 is fixed to the center of the partition plate 121 and located above the gas outlet 110*a* of the scroll assembly 110 (as shown in FIG. 1). After being installed in place, the silencing device 120 is independent from the scroll assembly 110, specifically, the silencer 122 is independent from the gas compression component formed by the non-orbiting scroll 111 and the orbiting scroll 112 or other additional components (such as the floating seal ring assembly 113). Here, "independent" represents that the silencer 122 can be in contact with the components of the scroll assembly 110 but is not fixed by these components, or can be isolated in space from the scroll assembly 110.

Due to such "independent" arrangement, compared with the existing silencer device mentioned in the background, the installation method of the silencer 122 of the silencer device 120 according to the present disclosure is more flexible, and various connection manners such as welding connection, interference fit connection, threaded connection can be used to fix the silencer 122 to the partition plate 121. As shown in FIG. 7, the partition plate 121 has a central through hole 121*b* for fixing the silencer 122 which is then firmly fixed into the central through hole 121*b* by welding, interference fit connection or threaded connection.

In existing compressors in the background, the orbiting scroll and the non-orbiting scroll are usually made of cast iron, which is not a base material suitable for welding connection, so the silencer is not suitable for fixing to the non-orbiting scroll or the orbiting scroll by welding. Based on the existing silencer arrangement, it is also difficult to adopt interference fit connection. The silencer needs to be interference press-fitted into the inner hub of the orbiting scroll, and if there is a reed valve, the silencer will be installed to be capable of accurately fixing the reed valve. The actual assembly process is difficult and requires a complicated press-fitting apparatus. In addition, additional structures may be required to compensate for component tolerances and accuracy errors, resulting in a complex assembly structure, which is not suitable for practical applications. Although the silencer in the background can be fixed to the orbiting scroll by threaded connection, such manner is not suitable for an orbiting scroll with a thin inner hub, as explained in the background.

The silencer 122 according to the present disclosure is not directly fixed to the orbiting scroll 112 but is fixed to the partition plate 121. Such arrangement allows the silencer 122 to be installed by using the above-mentioned multiple connection manners. For the welding connection, by selecting suitable materials with good weldability to make the partition plate 121 and the silencer 122, a good welded joint can be obtained without changing the materials of the non-orbiting scroll and the orbiting scroll. For example, the silencer 122 may be made of carbon steel, powder metallurgy materials, or metals such as copper, and the partition plate 121 may be made of carbon steel. For press-fit installation, the process of press-fitting the silencer 122 into the partition plate 121 is relatively simple and can be performed independently, and the press-fitting apparatus is simple. For threaded connection, the threaded connection portion can be formed on the partition plate 121 and the silencer 122 respectively, and the inner hub 112*b* of the orbiting scroll 112 does not need to have a large thickness to form the threaded connection portion, so that an orbiting scroll 112 with an inner hub having thin-wall can be used. In the case of press-fit installation and threaded installation, the partition plate 121 and the silencer 122 can also be made of cast iron materials. Although the welding performance is not high, the cast iron materials have excellent castability, workability, and wear resistance and shock absorption, and can provide good mechanical performance for the partition plate 121 and the silencer 122.

The "independent" arrangement of the silencer 122 according to the present disclosure also allows the position and size of the silencing device 120 to be flexibly adjusted, allows additional components to be added to the scroll assembly 110 without interference with the silencing device 120, and thus the design of the scroll assembly 110 is also more flexible.

Figure 9A:
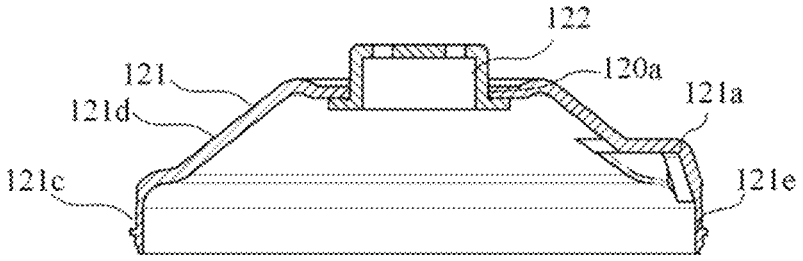
FIGS. 9A to 9D show cross-sectional views of the silencing device taken along the line A-A in FIG. 8, which show four different ways of fixation of the silencer.
Figure 9B:
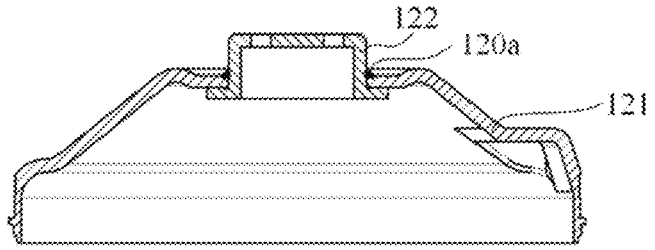
Figure 9C:
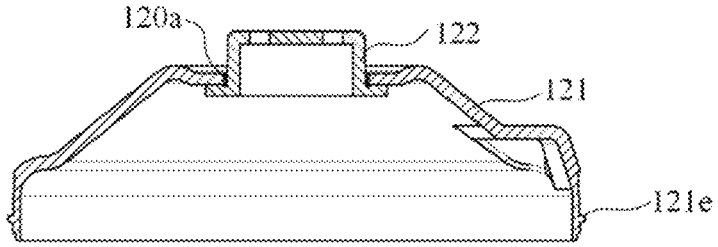
Figure 9D:
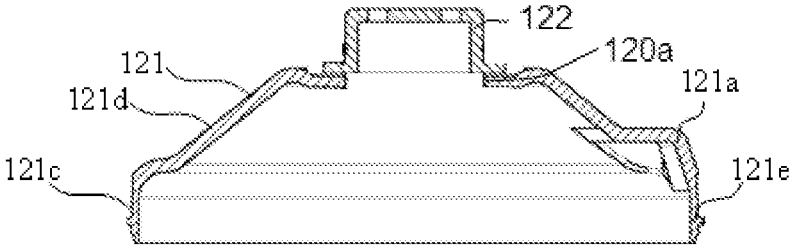

FIGS. 8 and 9A to 9D specifically show an exemplary connection manner of the silencer device 120 according to the present disclosure. FIG. 9A shows a press-fit installation manner, FIGS. 9B and 9D show a welding installation method, and FIG. 9C shows a threaded connection installation manner. In these three connection manners, the silencer 122 and the partition plate 121 are connected to each other at an engagement part 120*a*, respectively. FIG. 9B shows a welded joint at the engagement part 120*a*, and FIG. 9C shows the threaded connection portion at the engagement part 120*a*.

Figure 14:
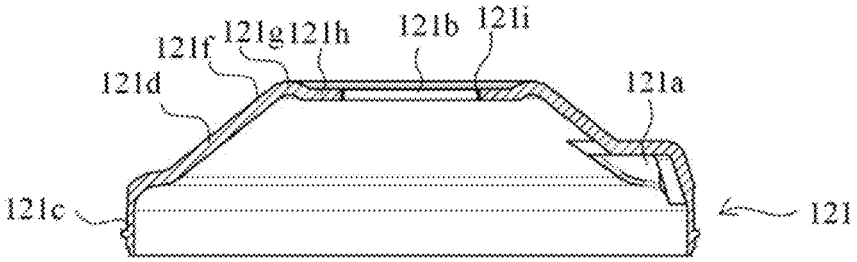
Figure 18:
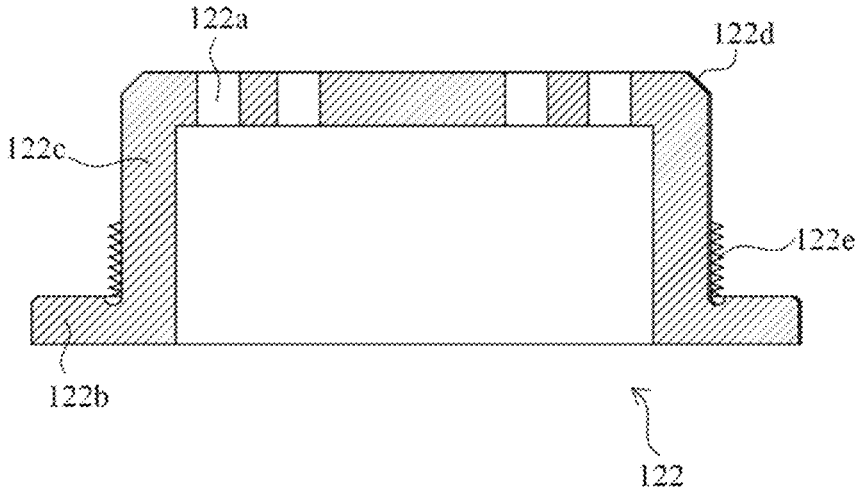
FIG. 18 is a cross-sectional view of a silencer using a threaded connection according to an embodiment of the present disclosure, in which an enlarged threaded connection portion is shown.

Specifically, as best shown in FIG. 18, the outer side of the silencer 122 is formed with external thread 122*e*, and the external thread 122*e* is located at the engagement part 120*a* of the silencer 122 and the central through hole 121*b* of the partition plate 121. The inner side of the central through hole 121*b* of the partition plate 121 is formed with a corresponding internal thread 121*i* (as shown in FIG. 14) so as to be engaged with the external thread 122*e* of the silencer 122. As understood by those skilled in the art, compared to welding connection and press-fit connection, threaded connection makes it easier to disassemble and replace components. However, if the airtightness requirements are considered, welding connections and press-fit connections are more advantageous.

In addition, although not shown in the Figures, the partition plate 121 may also be adopted in other configurations. For example, a flange portion extending upward may be formed at the periphery of the central through hole 121*b* of the partition plate 121, and the silencer 122 may be fixedly connected to the outer side of the flange portion. In addition, it may be considered that the silencer 122 is directly welded to the periphery of the central through hole 121*b* of the partition plate 121 without providing a flange portion. In this case, the entire silencer 122 is located at outer side (upper side) of the partition plate 121 and is not "inserted" in the partition plate 121. However, it is also conceivable that when the partition plate 121 is provided with a flange portion, the silencer 122 (not provided with an annular flange) can also be arranged to be inserted only into the inner side of the flange portion or set on the outer side of the flange portion, or the silencer 122 (with or without an annular flange disposed) may also be arranged to be inserted into both the inner side of the flange portion and the inner side of the central through hole.

Figure 10:
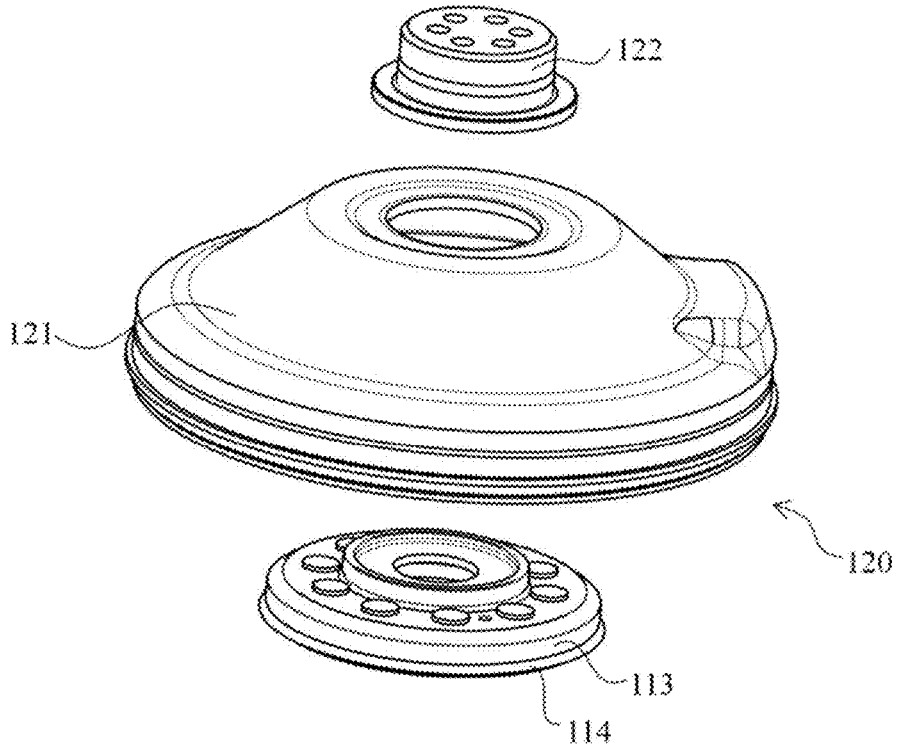
FIG. 10 shows a schematic diagram of a silencing device and a floating seal ring assembly in a scroll compressor according to an embodiment of the present disclosure.
Figure 11:
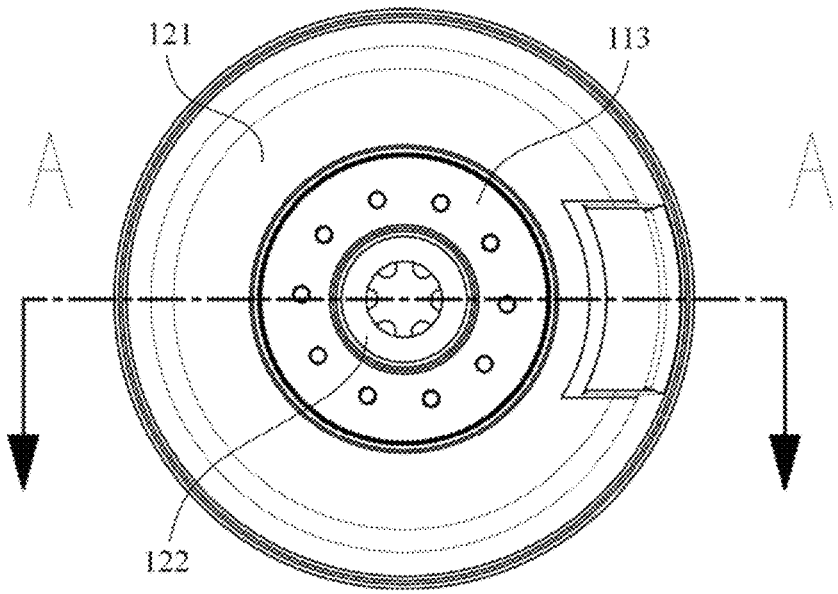
FIG. 11 shows a bottom view of the silencing device and floating seal ring assembly in FIG. 10 in a state of being arranged in place.
Figure 12:
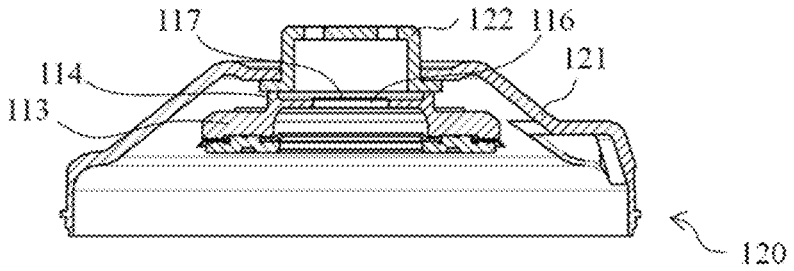
FIG. 12 shows a cross-sectional view taken along the line A-A of FIG. 11.

FIGS. 10 to 12 show illustrations of the silencing device 120 and the floating seal ring assembly 113 installed together according to an embodiment of the present disclosure. When the silencing device 120 is installed in place, the silencer 122 abuts against the sealing top end 114 of the floating seal ring assembly 113 to isolate the high pressure chamber 104 and the low pressure chamber 105 of the scroll compressor 100 from each other.

As shown in FIG. 12, the bottom of the silencer 122 abuts against the sealing top end 114 of the floating seal ring assembly 113 and partially covers the inner area of the sealing top end 114. Generally, the lateral dimension of the check valve sheet 117 will be smaller than the uncovered area inside the sealing top end 114. To prevent the check valve sheet 117 from escaping too far away from the floating seal ring assembly 113 to be reset, a check valve sheet limiting stud 118 can be provided and a part thereof extending upward is accommodated in the silencer 122. The height of the silencer 122 is designed to provide enough space for accommodating the limiting stud 118 inside it, and the specific height range will be described below.

Figure 15A:
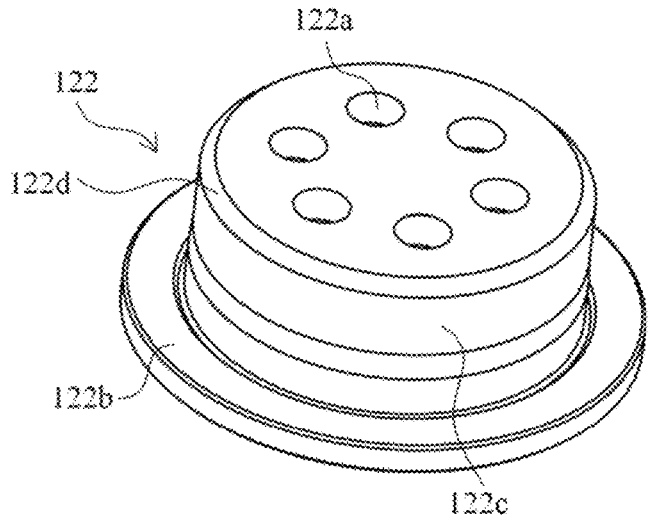
FIGS. 15A, 15B and 15C respectively show a perspective view, a top view, and a cross-sectional view taken along line A-A in the top view of the silencer of the silencing device according to an embodiment of the present disclosure.

In addition, based on the principles of the present disclosure, a simple embodiment without providing the floating seal ring assembly 113 can also be considered. The silencer 122 can be arranged to directly abut against the inner hub 112*b* of the orbiting scroll 112. In this case, a flexible sealing ring needs to be provided between the annular flange 122*b* of the silencer 122 (as shown in FIG. 15A) and the inner hub 112*b* of the orbiting scroll 112 so as to achieve sealing on the one hand and ensure that the gas discharged from the gas outlet 110*a* smoothly enters the silencer 122 and on the other hand, to prevent the vibration, such as of the scroll assembly from being transmitted to the partition plate 121 and the compressor housing. Based on this arrangement, the overall height of the silencing device 120 can also be reduced.

Figure 13:
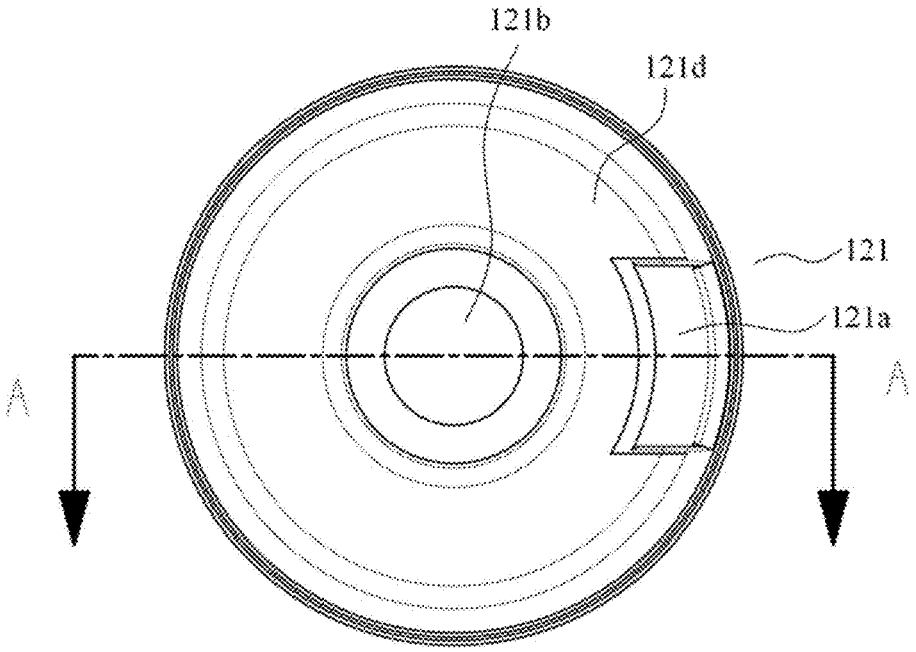
FIGS. 13 and 14 show a bottom view and a cross-sectional view of the partition plate of the silencing device according to an embodiment of the present disclosure.

FIGS. 13 and 14 show schematic diagrams of the partition plate 121 according to an embodiment of the present disclosure. The structure of the partition plate 121 of the silencing device 120 according to the present disclosure is designed to facilitate the installation of the silencer 122, while it is able to accommodate and cover other components of the scroll assembly below. As shown in the Figures, the partition plate 121 mainly includes an umbrella body 121*d*, a cylindrical portion 121*c*, and a ring attachment portion 121*e*.

A central through hole 121*b* for mounting the silencer 122 is formed in the center of the umbrella body 121*d*, and the umbrella body 121*d* expands and extends outward from the central through hole 121*b* so as to cover the scroll assembly 110 below. Specifically, the umbrella body 121*d* is composed of a horizontal section 121*h* extending from the central through hole 121*b* and an inclined section 121*f* extending from the horizontal section 121*h*, and a protruding arc portion 121*g* may be provided between the horizontal section 121*h* and the inclined section 121*f* to improve the structure strength of the umbrella body 121*d*. The "umbrella" structure of the umbrella body 121*d* can provide a more stable installation platform for the silencer 122, and at the same time leave enough accommodating space for the high-pressure chamber 104 above for accommodating additional components.

The cylindrical portion 121*c* extends substantially vertically downward from the periphery of the umbrella body 121*d* to form a joint area for joining an external structure (such as the compressor housing). After being installed in place, the cylindrical portion 121*c* can follow the inner wall of the compressor housing.

The annular attachment portion 121*e* is formed to extend radially outward around the cylindrical portion 121*c*, for example, it may be formed as an annular lip for engaging the compressor housing. The partition plate 121 is attached to the joint position of a top cover 101 and a housing body 102 by represents of a ring attachment portion 121*e*, and then is fixed by welding or the like. The provision of the cylindrical portion 121*c* and the annular attachment portion 121*e* helps the partition plate 121 to be more securely installed to external components (the improved structure strength of the partition plate 121 itself and the stable installation of the partition plate 121 and external components also avoid the excessive shock of the partition plate and further of the compressor housing in the case that the silencing device 120 is installed on the partition plate), and provides a better sealing effect, but its specific structure is not limited to the form shown in the drawings, any structure suitable for fixing and installing the partition plate 121 is feasible. Thus, the partition plate 121 is not only used to install the silencer 122, but also can seal and separate the high-pressure chamber 104 from the low-pressure chamber 105 together with the silencer 122 (by represents of the annular flange of the silencer 122 used as a sealing plate). The silencing cover (partition plate) of the existing silencing device must be combined with an additional specially designed sealing seat component to achieve the effect of sealing and separating the high-pressure chamber from the low-pressure chamber.

The partition plate 121 also includes a boss portion 121*a* formed on the umbrella body 121*d*, and the boss portion 121*a* provides an extra accommodation space inside the umbrella body 121*d* for accommodating additional devices on the scroll assembly 110, such as the additional jet port 109 shown in FIG. 1. The form of the boss portion 121*a* is not limited to the "stepped" structure shown in the figure, and can be adjusted according to the shape of the additional device that needs to be accommodated in practice.

FIGS. 15A to 17C show multiple embodiments of the silencer 122 according to the present disclosure. In the figures, the configuration of the silencer 122 is shown to be substantially the same, and the difference lies in the position, number and aperture of the silencing hole 122*a* of the silencer 122 and the height and radial dimensions of the body part of the silencing device 120.

In the example shown in the figures, the silencer 122 includes a cylindrical body 122*c* and an annular flange 122*b* formed around the bottom of the cylindrical body 122*c*. Multiple silencing holes 122*a* are formed in the top and/or side walls of the cylindrical body 122*c*, and the noise will be significantly reduced when the compressed gas is discharged through the silencing holes 122*a*. After being installed in place, the cylindrical body 122*c* of the silencing device 120 protrudes into the high-pressure chamber 104, and discharges the compressed gas into the high-pressure chamber 104 while reducing noise.

The annular flange 122*b* is used to define the installation position of the silencer 122 relative to the partition plate 121. In the installed state, the annular flange 122*b* is arranged to abut against the bottom wall surface of the partition plate 121, as clearly shown in FIGS. 9A to 9C. Thus, the annular flange 122*b* can serve as a sealing surface for sealing the peripheral gap of the central through hole 121*b* of the partition plate 121 (used as a sealing plate suitable for engaging with the corresponding sealing member, such as the sealing top of the floating seal ring assembly), thereby sealing and separating the high pressure chamber 104 and the low pressure chamber 105 together with the partition plate 121. Therefore, the silencer 122 according to the present disclosure has both the function of silencing and the function of sealing and separating the high-pressure chamber 104 from the low-pressure chamber 105. The sealing and separating function also ensures that the sound energy of the gas discharged from the gas outlet 110*a* is transmitted to the silencer 122, but not transmitted to the partition plate 121 and the compressor housing.

Advantageously, the top edge of the cylindrical body 122*c* of the silencer 122 is chamfered or rounded to eliminate sharp edges.

By adjusting the height and radial size of the cylindrical body 122*c*, the number, aperture, and position of the silencing holes 122*a*, different silencing effects can be obtained, and in particular, different silencing holes arrangements can be designed for a certain specific frequency of noise, and the like, and thus the silencer according to the present disclosure can achieve a good noise reduction effect for a certain frequency (for example, the frequency related to the noise caused by the reed valve).

Figure 15B:
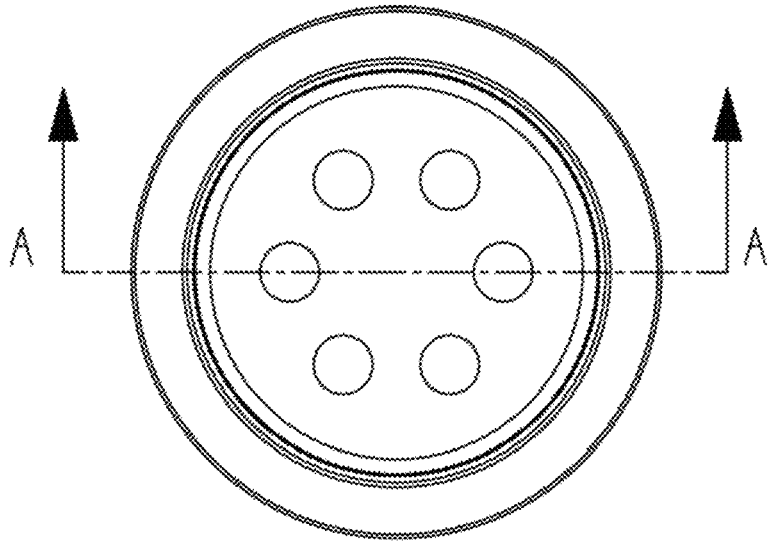
Figure 15C:
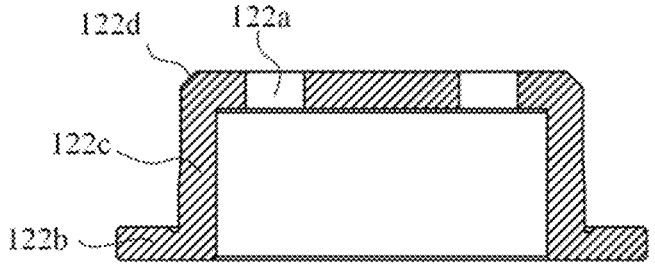
Figure 16A:
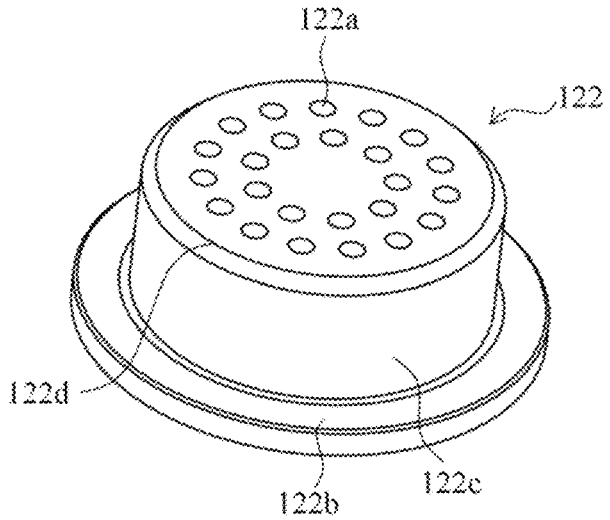
FIGS. 16A, 16B and 16C respectively show a perspective view, a top view, and a cross-sectional view taken along line A-A in the top view of the silencer according to another embodiment of the present disclosure.
Figure 16B:
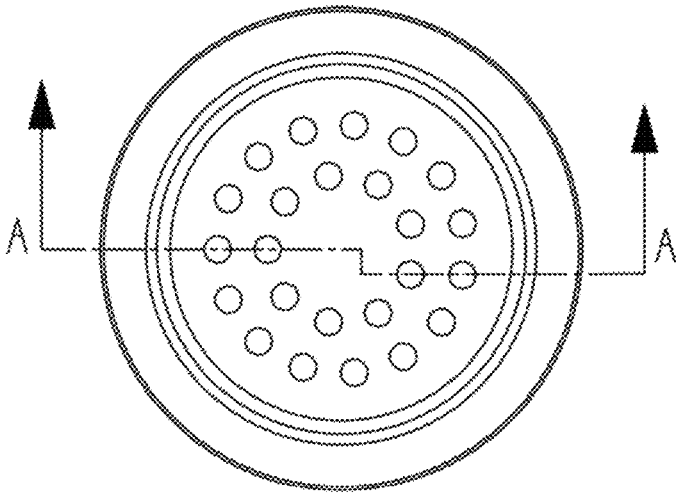
Figure 16C:
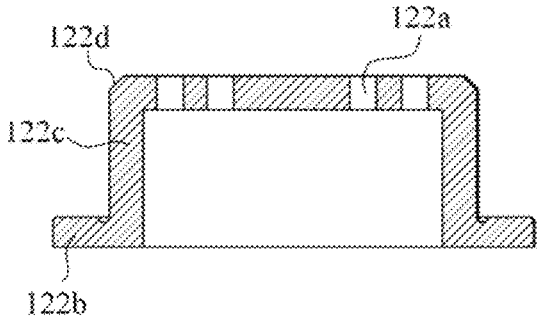
Figure 17A:
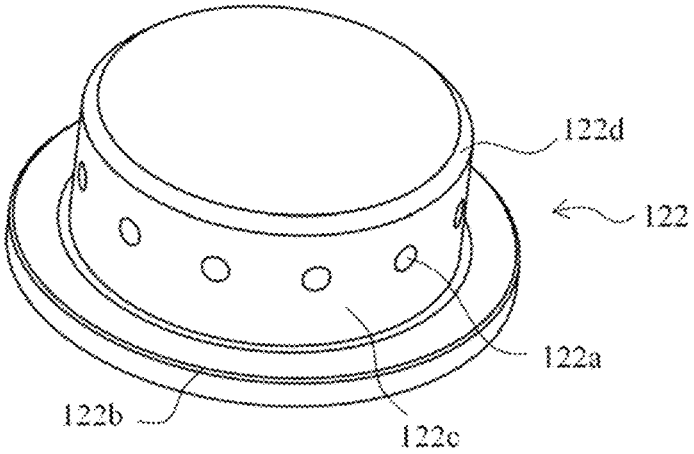
FIGS. 17A, 17B and 17C respectively show a perspective view, a top view, and a cross-sectional view taken along line A-A in the top view of the silencer according to still another embodiment of the present disclosure.
Figure 17B:
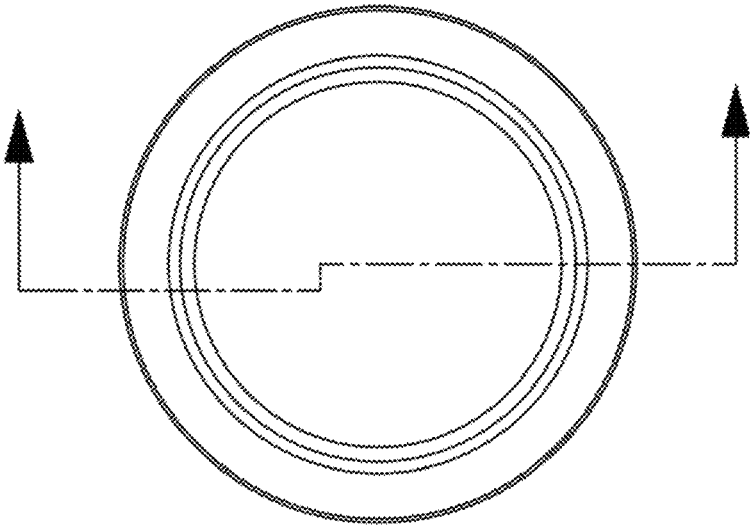
Figure 17C:
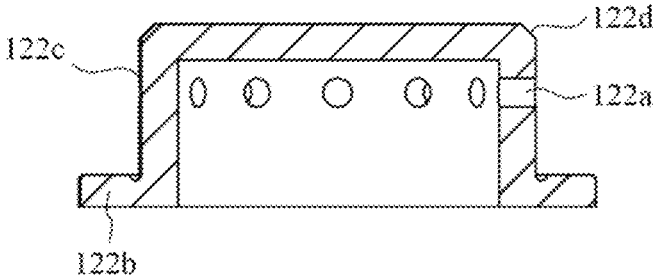

The top of the cylindrical body 122*c* shown in FIGS. 15A to 15C is formed with 6 holes with a diameter of ø8 mm, and the top of the cylindrical body 122*c* shown in FIGS. 16A to 16C is formed with 24 holes with a diameter of ø4 mm. In the example of FIGS. 17A to 17C, a series of silencing holes

122*a* are formed around the side wall of the cylindrical body 122*c* of the silencer 122, for example, which may be 24 holes with a diameter of ø4 mm or 6 holes with a diameter of 08 mm.

According to the principle of the present disclosure, when the total channel area of the holes on the silencer 122 is constant, the size of the silencing holes 122*a* decreases and the number thereof increases accordingly. The silencing effect of multiple silencing holes 122*a* with small-aperture is better than the silencing effect of a small amount of silencing holes 122*a* with large-aperture. Therefore, in the above example, the silencing effect of the 24 silencing holes 122*a* with a diameter of ø4 mm is better than that of the 6 silencing holes 122*a* with a diameter of ø8 mm. At the same time, too many silencing holes of reduced size will increase the processing cost. According to the present disclosure, after comprehensively considering the above factors, a silencer that is easier to process and has a good noise reduction effect (especially a good reduction effect for noise with a certain specific frequency) is designed.

The height and radial size of the silencer 122 also affect the silencing effect. The cylindrical body 122*c* of the silencer 122 according to the present disclosure may have a height in the range of 20 mm to 40 mm, and a radial dimension (for example, the diameter of the cylinder) in the range of 20 mm to 80 mm. The height and radial size of the silencer 122 are positively correlated with the silencing effect, that is, as the height and/or outer diameter size increases, the silencing effect is optimized. The height and radial dimension can be selected based on the displacement size of the scroll assembly 110, the dimension (height, outer diameter) of the partition plate 121, and the desired silencing effect (for example, silencing for noise in a certain specific frequency band).

According to the principles of the present disclosure, the silencing process of the silencer 122 follows the following sound energy transmission loss formula:

$$TL\ (\text{dB}) = 101g\left(\frac{W_{in}}{W_{out}}\right) = 101g\left(\frac{P_{in}^2 A_{in}}{P_{out}^2 A_{out}}\right) = 101g\left(\frac{P_{in}^2 A_{in}}{P_{out1}^2 A_{out1} + P_{out2}^2 A_{out2} + \ldots + P_{outn}^2 A_{outn}}\right)$$

In the formula above, "TL" represents sound energy transmission loss, "W" represents sound power, "P" represents sound pressure, "A" represents flow area, the subfix "in" represents the silencer entrance, and the subfix "out" represents the silencer exit, that is the silencing holes.

Figure 19:
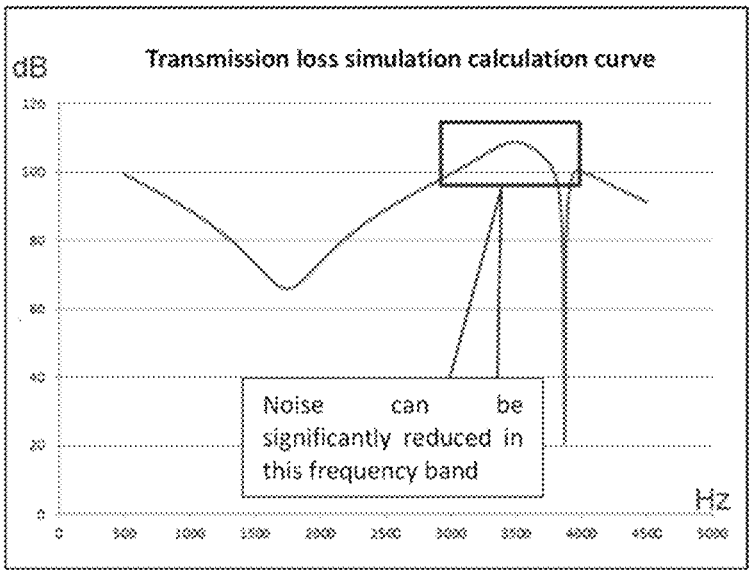
FIG. 19 shows a simulation calculation curve of sound energy transmission loss of the silencing device according to an embodiment of the present disclosure.

FIG. 19 shows the sound energy transmission loss simulation calculation curve of the silencing device 120 according to the present disclosure which is obtained based on this formula. It can be seen from the figure that the specially designed silencing device 120 according to the present disclosure has a significant reduction effect on the noise in the 3000 Hz~3500 Hz frequency band.

In addition to simulating the noise reduction effect, the applicant has also conducted experimental assembly and calibration operating point noise tests on various compressor models to verify the actual noise reduction effect of the silencing device 120 according to the present disclosure. The test conditions used are shown in Table 1 and Table 2 below.

TABLE 1

| Serial No. of the Tester | Sound Condition: 41 F./131 F. | Whether a Silencing Device is Installed |
|---|---|---|
| 1 | 79.6 dB(A) | Yes |
| 2 | 80.5 dB(A) | Yes |
| 3 | 80.5 dB(A) | Yes |
| 4 | 81.2 dB(A) | Yes |
| 5 | 80.7 dB(A) | Yes |
| 6 | 85.4 dB(A) | No |

TABLE 2

| Serial No. of the Tester | Sound Condition: 41 F./131 F. | Whether a Silencing Device is Installed |
|---|---|---|
| 7 | 83.7 dB(A) | Yes |
| 8 | 87.6 dB(A) | No |

Note: 41F in the above tables represents the saturated evaporation temperature of the compressor working fluid (for example, refrigerant), and 131F represents the saturated condensation temperature of the compressor working fluid.

Figure 20A:
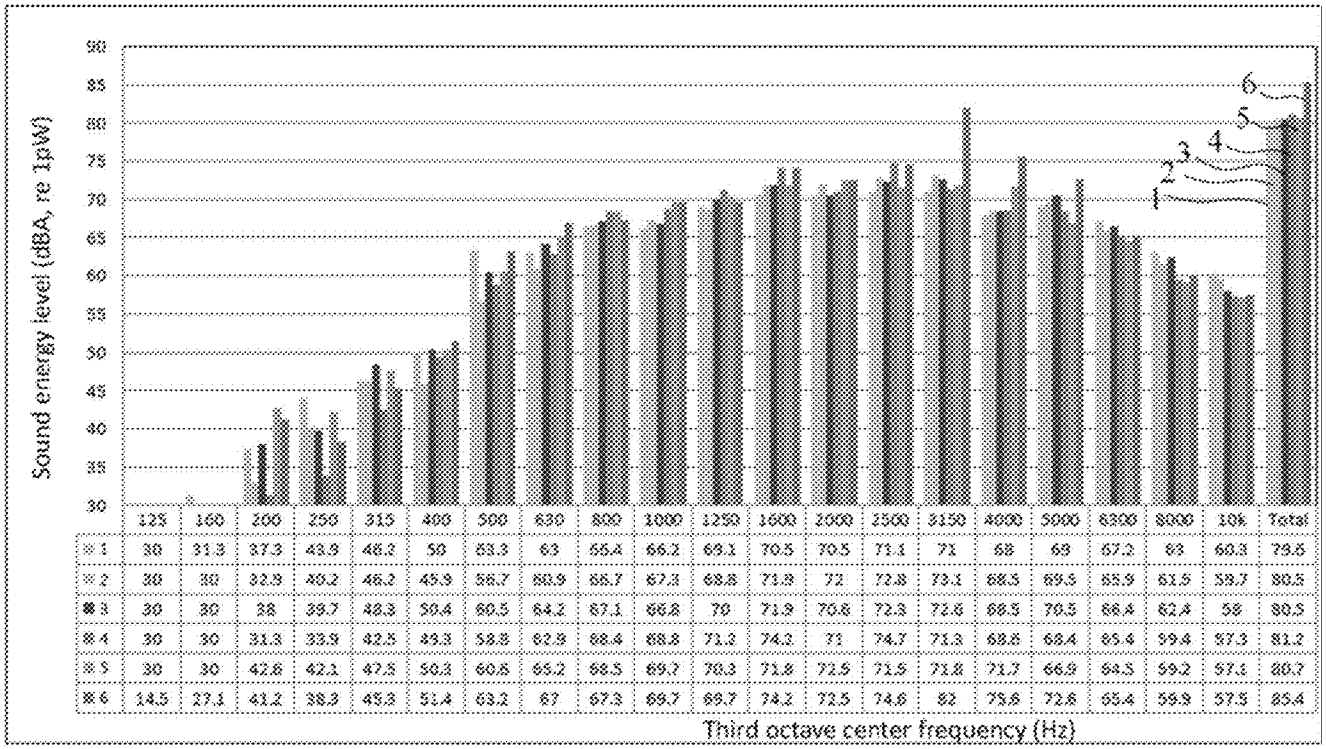
FIGS. 20A and 20B are diagrams showing test results of the actual noise reduction effect of the silencing device according to an embodiment of the present disclosure.
Figure 20B:
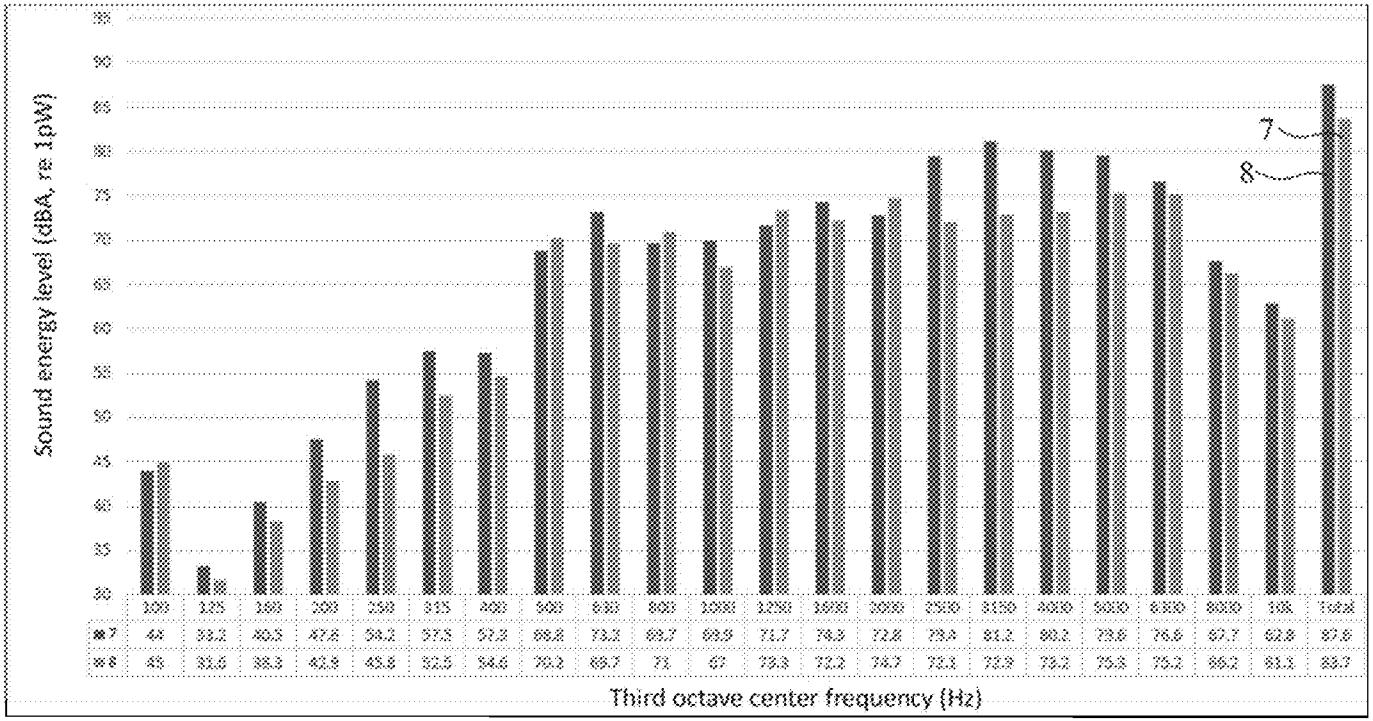

The test results are shown in the graphs in FIG. 20A (for Table 1) and FIG. 20B (for Table 2). The actual measurement results show that the overall operating noise of the compressor has been reduced by about 4~5 dB(A) ("A" here represents that the noise test is weighted by A-level), especially in the desired noise reduction frequency band near 3150 Hz, the noise reduction effect is obvious (the noise source of this frequency band is mainly caused by the reed valve tapping), with a noise reduction of about 10 dB(A) and a significant improvement in the actual listening experience.

In general, the silencing device 120 according to the present disclosure can provide the beneficial effects as follows:

1. The silencer 122 of the silencing device 120 is directly assembled to the partition plate 121 and is independent from the scroll assembly 110. Therefore: the size design and layout are more flexible and can be adjusted according to the structure of the scroll assembly 110; the structure of the scroll assembly 110 is not limited, for example, which eliminates the limits on the type of floating seal ring assembly and the wall thickness of inner hub of the scroll; the assembly process is simplified.
2. The annular flange 122*b* of the silencer 122 is suitable for abutting against the partition plate 121, and also suitable for abutting against such as the sealing top end 114 of the floating seal ring assembly 113 to seal and isolate the high-pressure chamber from the low-pressure chamber, such that all the discharged compression gas is introduced into the silencer 122 to avoid the noise sound energy to be transmitted to the partition plate 121 and the compressor housing. Therefore, the silencer 122 has both the function of silencing and isolating the high pressure chamber from the low pressure chamber.
3. Through experiments, it is found that the actual noise reduction effect of the silencing device 120 is positively correlated with the simulated noise reduction effect, which proves that the silencer 122 can achieve accurate and effective reduction for noise with a certain specific frequency by changing the dimension parameters of the silencing hole and the cylindrical body.

Although various embodiments of the present disclosure have been described in detail herein, it should be understood that the present disclosure is not limited to the detailed embodiments described and shown in detail here, and other variations and variants can be achieved by those skilled in the art without departing from the essence and scope of the present disclosure. All these variations and variants fall within the scope of the present disclosure. Moreover, all the members described herein can be replaced by other technically equivalent members.

The invention claimed is:

1. A scroll compressor, comprising:

a scroll assembly comprising an orbiting scroll and a non-orbiting scroll, the orbiting scroll and the non-orbiting scroll comprising respectively an orbiting scroll profile and a non-orbiting scroll profile and cooperating with each other to form a series of compression chambers, and the scroll assembly defining a gas outlet; and a silencing device arranged above the scroll assembly and comprising a partition plate and a silencer, the partition plate having an upper surface and a bottom surface opposing the upper surface and a central through hole, the silencer further comprising a cylindrical body and an annular flange extending radially outward along a bottom of the cylindrical body, the partition plate being configured to divide an internal space of the scroll compressor into a high-pressure chamber and a low-pressure chamber, and the silencer being arranged above the gas outlet, wherein the silencer is fixed to the partition plate such that the annular flange abuts against the bottom surface of the partition plate, and so that at least a portion of the silencer extends upwardly from the abutted annular flange and beyond the upper surface of the partition plate, the silencer is positioned in the central through hole, and the fixed silencer is independent from the scroll assembly.

2. The scroll compressor according to claim 1, wherein:

the silencer is fixed to the central through hole by welding, interference fit or threaded connection so as to be fixed to the partition plate.

3. The scroll compressor according to claim 2, wherein: the bottom of the silencer is formed on the outer side with an external thread, and the inner side of the central through hole of the partition plate is formed with a corresponding internal thread.

4. The scroll compressor according to claim 1, wherein the cylindrical body has one or more silencing holes formed in the top or side wall of the cylindrical body.

5. The scroll compressor according to claim 4, wherein the top of the cylindrical body comprises a plurality of silencing holes arranged in an annular form or side wall of the cylindrical body comprises a plurality of silencing holes arranged in the circumferential direction of the cylindrical body.

6. The scroll compressor according to claim 4, wherein the height of the cylindrical body ranges from 20 mm to 40 mm, and/or, the radial dimension of the cylindrical body ranges from 20 mm to 80 mm.

7. The scroll compressor according to claim 1, wherein the annular flange abuts against the bottom surface of the partition plate such that the annular flange is configured as a sealing plate adapted to engage with a sealing member to seal and isolate the high-pressure chamber from the low-pressure chamber.

8. The scroll compressor according to claim 1, wherein the scroll compressor further comprises a reed valve arranged at the gas outlet, and the silencer is arranged to align with the gas outlet to reduce the operating noise of the reed valve.

9. The scroll compressor according to claim 1, wherein the scroll assembly comprises a recess provided on the side of the non-orbiting scroll facing away from the orbiting scroll, and the scroll compressor further comprises a floating seal ring assembly arranged in the recess to define a back pressure chamber.

10. The scroll compressor according to claim 9, wherein the floating seal ring assembly has a sealing top end abutting against the annular flange of the silencer to seal and isolate the high-pressure chamber from the low-pressure chamber.

11. The scroll compressor according to claim 10, wherein the floating seal ring assembly has a lip extending radially inward from the seal top end, and the scroll compressor further comprises a check valve sheet arranged on the lip to cover the air flow channel at the inner side of the lip.

12. The scroll compressor according to claim 11, wherein the scroll compressor further comprises a stop portion accommodated inside the silencer for limiting the upward movement range of the check valve sheet.

13. The scroll compressor according to claim 1, wherein the silencer is configured to reduce noise within a desired frequency range.

14. The scroll compressor according to claim 13, wherein the desired frequency range is 3,000-3,500 Hertz (Hz).

* * * * *